US009089470B2

(12) United States Patent
Lev et al.

(10) Patent No.: US 9,089,470 B2
(45) Date of Patent: Jul. 28, 2015

(54) BODY MASSAGER

(75) Inventors: Mordechai Lev, West Bloomfield, MI (US); Sara Robertson, Walled Lake, MI (US)

(73) Assignee: FKA Distributing Co., Commerce Township, MI (US)

( * ) Notice: Subject to any disclaimer, the term of this patent is extended or adjusted under 35 U.S.C. 154(b) by 611 days.

(21) Appl. No.: 13/510,784

(22) PCT Filed: Nov. 19, 2010

(86) PCT No.: PCT/US2010/057383

§ 371 (c)(1),
(2), (4) Date: May 18, 2012

(87) PCT Pub. No.: WO2011/063206

PCT Pub. Date: May 26, 2011

(65) Prior Publication Data

US 2012/0232445 A1 Sep. 13, 2012

Related U.S. Application Data

(60) Provisional application No. 61/262,623, filed on Nov. 19, 2009.

(51) Int. Cl.
*A61H 7/00* (2006.01)
*A61H 23/02* (2006.01)

(52) U.S. Cl.
CPC .... *A61H 23/0254* (2013.01); *A61H 2201/0134* (2013.01); *A61H 2201/0149* (2013.01);

(Continued)

(58) Field of Classification Search
CPC ..... A61H 23/0254; A61H 2201/0134; A61H 2201/0149; A61H 2201/0165; A61H 2201/1628; A61H 2201/164; A61H 2201/1678; A61H 2201/1623; A61H 2205/12; A61H 2205/081
USPC ..... 601/15, 84, 89, 90, 91, 92, 93, 94, 97, 601/98, 101, 103, 107, 108, 111, 112, 113, 601/134, 136
See application file for complete search history.

(56) References Cited

U.S. PATENT DOCUMENTS 6,089,664 A 7/2000 Yoshida
2005/0209539 A1 9/2005 Lev et al.

(Continued)

FOREIGN PATENT DOCUMENTS

CN 201150633 Y 11/2008
CN 201267597 Y 7/2009

(Continued)

OTHER PUBLICATIONS

International Preliminary Report for corresonding PCT Application No. PCT/US2010/057383, mailed May 31, 2012, 9 pages.

*Primary Examiner* — Quang D Thanh
(74) *Attorney, Agent, or Firm* — Brooks Kushman P.C.

(57) ABSTRACT

A massager is provided with a housing having a first guide oriented in a longitudinal direction. A carriage is oriented in the housing and cooperates with the first guide for translation. A motor is supported upon one of the carriage and the housing and operably connected to the other for translating the carriage along the first guide. A second guide is mounted to the housing and oriented generally canted relative to the longitudinal direction. A massage member is pivotally connected to the carriage and pivotally connected to the second guide such that as the carriage is translated along the first guide, and angular orientation of the massage member is rotated relative to the carriage.

14 Claims, 7 Drawing Sheets

(52) U.S. Cl.
CPC ... *A61H2201/0165* (2013.01); *A61H 2201/164* (2013.01); *A61H 2201/1623* (2013.01); *A61H 2201/1628* (2013.01); *A61H 2201/1678* (2013.01); *A61H 2205/081* (2013.01); *A61H 2205/12* (2013.01)

(56) References Cited

U.S. PATENT DOCUMENTS

| | | | | |
|---|---|---|---|---|
| 2006/0211962 | A1 | 9/2006 | Ferber et al. | |
| 2007/0021695 | A1 | 1/2007 | Wu | |
| 2007/0027412 | A1 | 2/2007 | Li et al. | |
| 2007/0060851 | A1* | 3/2007 | Ferber et al. | 601/99 |
| 2008/0077061 | A1 | 3/2008 | Dehli | |
| 2008/0262398 | A1 | 10/2008 | Ferber et al. | |
| 2009/0270780 | A1 | 10/2009 | Wu et al. | |
| 2010/0318008 | A1 | 12/2010 | Wu et al. | |

FOREIGN PATENT DOCUMENTS

| | | | |
|---|---|---|---|
| CN | 201469598 | U | 5/2010 |
| WO | 2009146351 | A1 | 12/2009 |

* cited by examiner

BODY MASSAGER

CROSS-REFERENCE TO RELATED APPLICATION

This application is the U.S. national phase of PCT Appln. No. PCT/US2010/057383 filed on Nov. 19, 2010, which claims the benefit of U.S. provisional application Ser. No. 61/262,623 filed on Nov. 19, 2009, the disclosures of which are incorporated in their entirety by reference herein.

TECHNICAL FIELD

Various embodiments relate to body massagers.

BACKGROUND

The prior art has provided various massagers, including massagers with a housing, a carriage in the housing for translation in the housing, and a massage assembly on the carriage. Examples of carriage massagers include U.S. Pat. No. 7,128,721 B2 issued to Ferber et al. on Oct. 31, 2006, and U.S. Pat. No. 7,470,242 B2 issued to Ferber et al. on Dec. 30, 2008.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Embodiments of massagers are disclosed including massage effects such as: quad rolling translating along a T-shaped path, shiatsu, and rolling. Each novel massage embodiment may include any suitable massage assembly for providing longitudinal rolling massage effect, rotary massage effect, vibration massage effect, shiatsu, counter rotation or percussion massage effect, nipping massage effect, quad rolling massage effect, treading massage effect, Swedish massage effect, tapping or roller massage effect, individually or in conjunction with several massage modes. Additionally, each novel embodiment may include removable and replaceable massage heads for each of the massage effects listed in this application. The replaceable heads provide a user with the opportunity to adjust the type of massage effect desired and easy replacement of parts. Each embodiment may be provided with a controller for controlling the movement and location of the massage head within the embodiment. Each massage head may be activated individually or in conjunction with other massage heads and travel or remain stationary in any desired location along both vertical and horizontal axes of the cushion. The location, rotation and travel path of each massage head may be adjusted via an integrated or wireless controller. Additionally, each novel embodiment may include heat as an option for the user to enjoy a heated massage. Generally the massage head or a massage node lights up to indicate that the heat mode of the massager is ON. The light may or may not generate heat for the heat mode; for example, the light may only indicate that the heat mode is ON. Additionally, each novel embodiment may include a cooling feature which may include a Peltier chip and fan assembly for pulling air through the massage embodiment.

Figure 1:
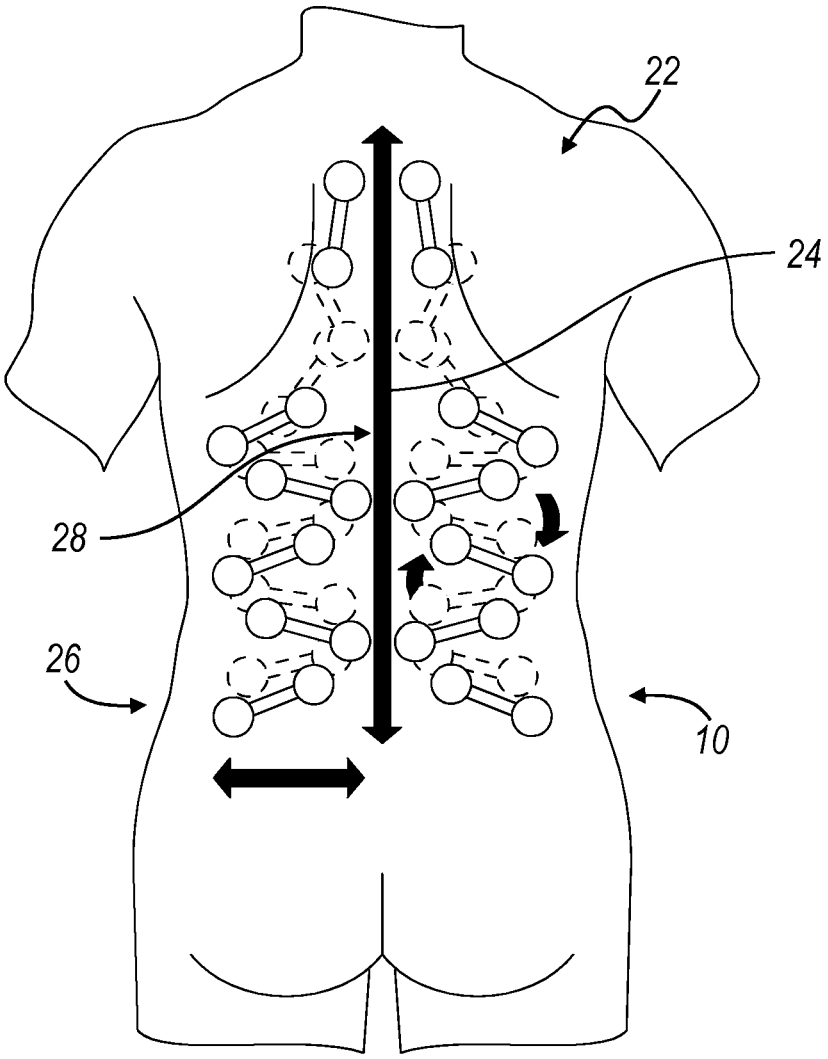
FIG. 1 is a schematic of a massage effect provided by a massager according to an embodiment.
Figure 2:
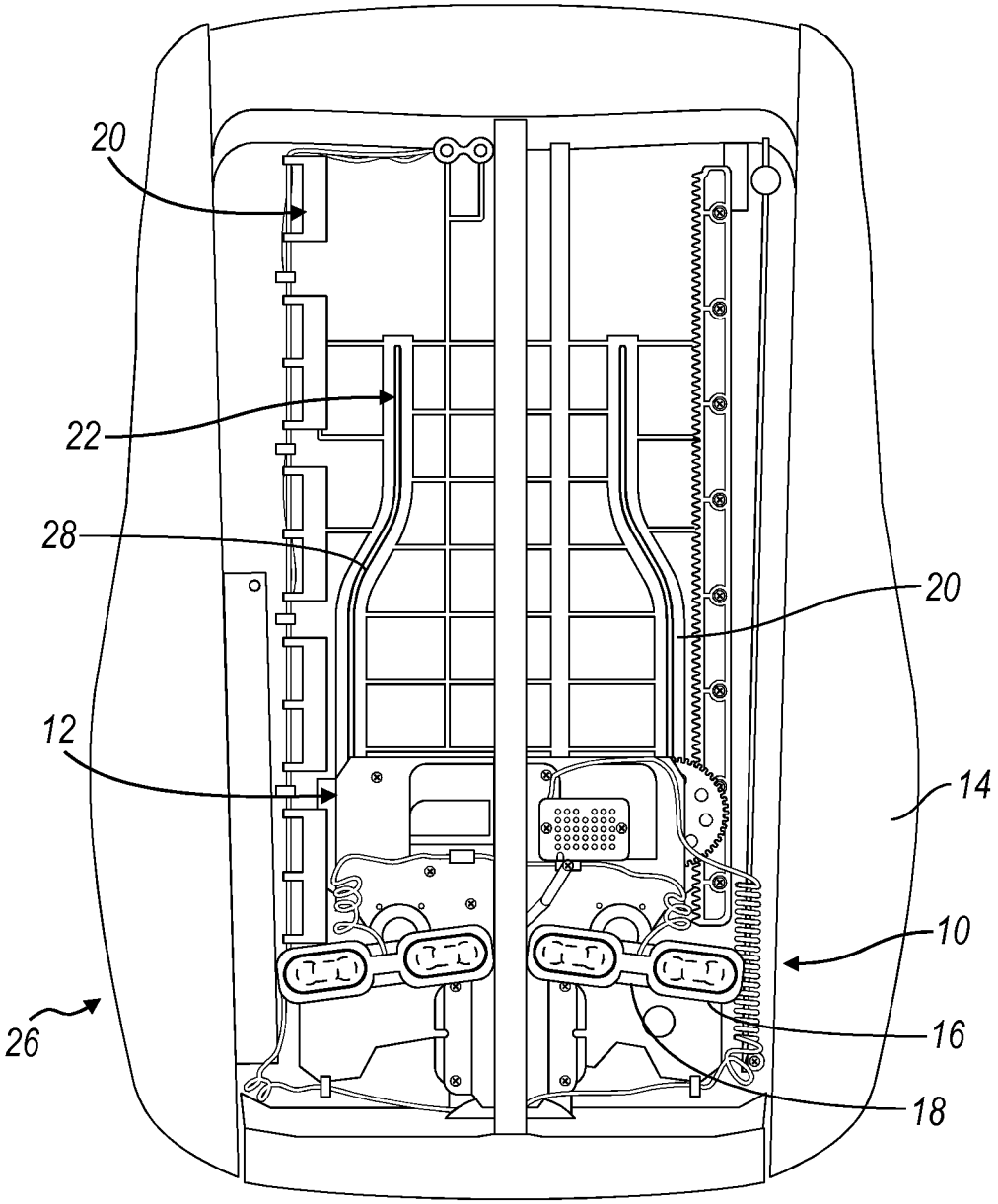
FIG. 2 is a front elevation view of a body massager illustrated partially disassembled, for providing the massage effect depicted in FIG. 1.

An embodiment of a quad rolling massage effect is illustrated in FIGS. 1 and 2. FIG. 1 provides a schematic of a quad rolling massage head 10 as it travels in an I-shape along the user's back. FIG. 2 illustrates two quad rolling massage heads 10 located on a carriage 12 within a massage cushion 14. The quad rolling massage head 10 preferably comprises two sets of opposing nodes 16 that rotate in a diametrically opposite direction while traveling in unison. Each massage head 10 includes two massage nodes 16 located at each end of a lever arm 18. The lever arm 18 is attached at its center to the carriage 12 for rotation along a central axis. The massage head 10 rotates approximately 30 degrees from center while "walking" up and down a user's back as shown in FIG. 1. The path of the massage heads 10 are essentially vertical along the user's spine with the massage nodes 16 oriented horizontally. As the massage heads 10 reach the upper and lower most point of a carriage travel path 20, the massage nodes 16 rotate to a vertical orientation and then branch out horizontally to fully massage the shoulders and lumbar area.

For example, the massage heads 10 may be neutralized at a shoulder region 22 with the nodes 16 vertically oriented and parallel to a central vertical axis as illustrated. Alternatively, the massage heads 10 may be neutralized at a lumbar region 26 with the nodes 16 vertically oriented and parallel to the central vertical axis 24. The opposing massage heads 10 travel from their outer most position along a horizontal axis to a central area 28 of the cushion 14. As the heads 10 travel, the heads 10 rotate back and forth along the central axis, rotating the opposing nodes 16 approximately thirty degrees from center in diametrically opposing directions. As the heads 10 near the central area 28, the nodes 16 rotate to a horizontally oriented plane and travel vertically along the user's spine area while maintaining the diametrically opposing massage head 10 rotation. As the massage heads 10 reach the user's shoulder area, the nodes 16 are rotated back to a vertical orientation and travel in opposing directions to the outermost shoulder areas of the user. The broadest travel path is in the shape of an "I". Alternatively, the massage heads 10 may travel along a "T" path providing a horizontal massage along the user's shoulders and a vertical massage along the spine. Alternatively, the massage path may be an upside down "T" with the horizontal massage along the user's lumbar region 26 and a vertical massage along the spine.

Figure 3:
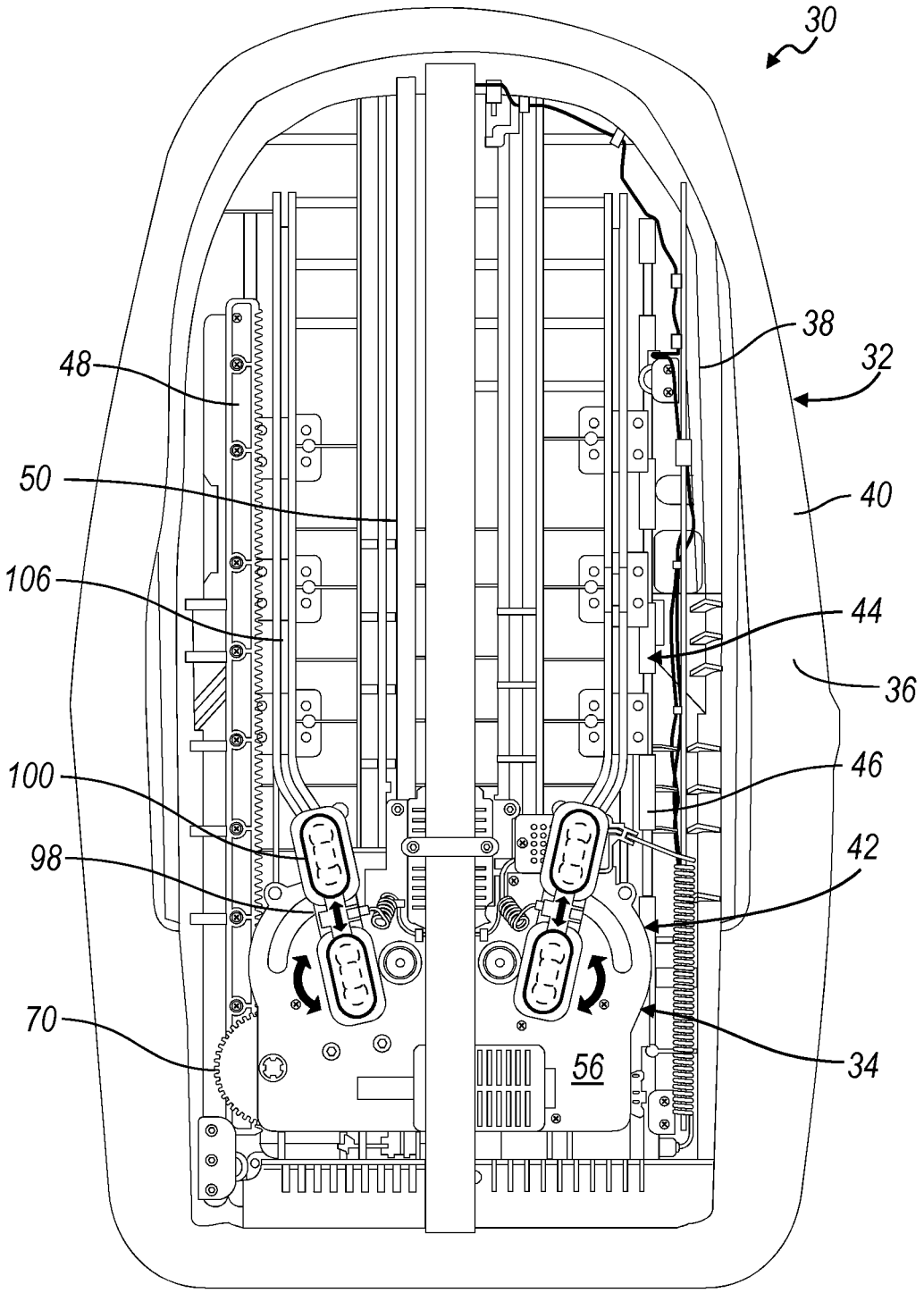
FIG. 3 is a front elevation view of a body massager according to another embodiment, illustrated partially disassembled.

Referring now to FIG. 3, an embodiment of a body massager is illustrated and referenced generally by numeral 30. In at least one embodiment, the body massager 30 is a portable body massager that is sized to be received and supported by a conventional chair. The body massager 30 includes a backrest 32, and may also include a seat support. The internal assemblies of the backrest 32 are collectively retained within a flexible cover (not shown).

Massaging effects provided by the body massager 30 include a kneading massage effect provided in the backrest 32, which is operable to provide the kneading massage effect longitudinally along the length of the backrest 32.

The backrest 32 is sized to be received upon a backrest of a conventional chair. The body massager 30 is portable due to its compact size and light weight so that the user may place the body massager 30 upon a conventional chair for receiving a massage when seated upon the chair.

The backrest 32 includes a height and width corresponding to the conventional chair and has a thickness that is adequate for housing a massage assembly 34 within the backrest 32 while avoiding disruption of comfort and support provided by the underlying chair.

The backrest 32 includes a backrest contact surface 36 for receiving and supporting the back of a user upon the surface 36. The massage assembly 34 of the backrest 32 imparts the respective massage effects through the backrest contact surface 36 through a cover (not shown) of the massager 30. The body massager 30 further includes a remote controller (not shown) connected to the massager 30 for controlling the operations of the massager 30.

The backrest 32 includes a housing 38 for retaining the massage assembly 34. A cushion 40 is provided on the housing 38 for providing comfort and support to the backrest contact surface 36. The massage assembly 34 includes a carriage 42 which cooperates with the housing 38 for limited longitudinal translation within the backrest 32. Accordingly, the housing 38 includes a longitudinal guide 44 for cooperating with the carriage 42. The guide 44 includes a series of gibs 46 that cooperate with and retain a longitudinal key (not shown) formed laterally along the carriage 42. Various features of the massage assembly 34 are illustrated and described in greater detail in Ferber et al. U.S. Pat. No. 7,128,721 B2, which issued on Oct. 31, 2006 and is incorporated by reference herein for disclosing the key on the carriage 42. The carriage 42 includes a second longitudinal key (not shown) formed laterally thereupon and transversely spaced opposition to that of the first key. The second key is retained relative to the housing 38 by an elongate retainer gib 48 which is secured to the housing 38.

The longitudinal guide 44 of the housing 38 includes longitudinal rails 50, which extend from the housing 38 and are received within keyways formed longitudinally through the carriage 42. The cooperation of the rails 50 and the carriage 42 provides transverse guidance and support to the carriage 42 as it translates along the longitudinal guide 44.

Figure 4:
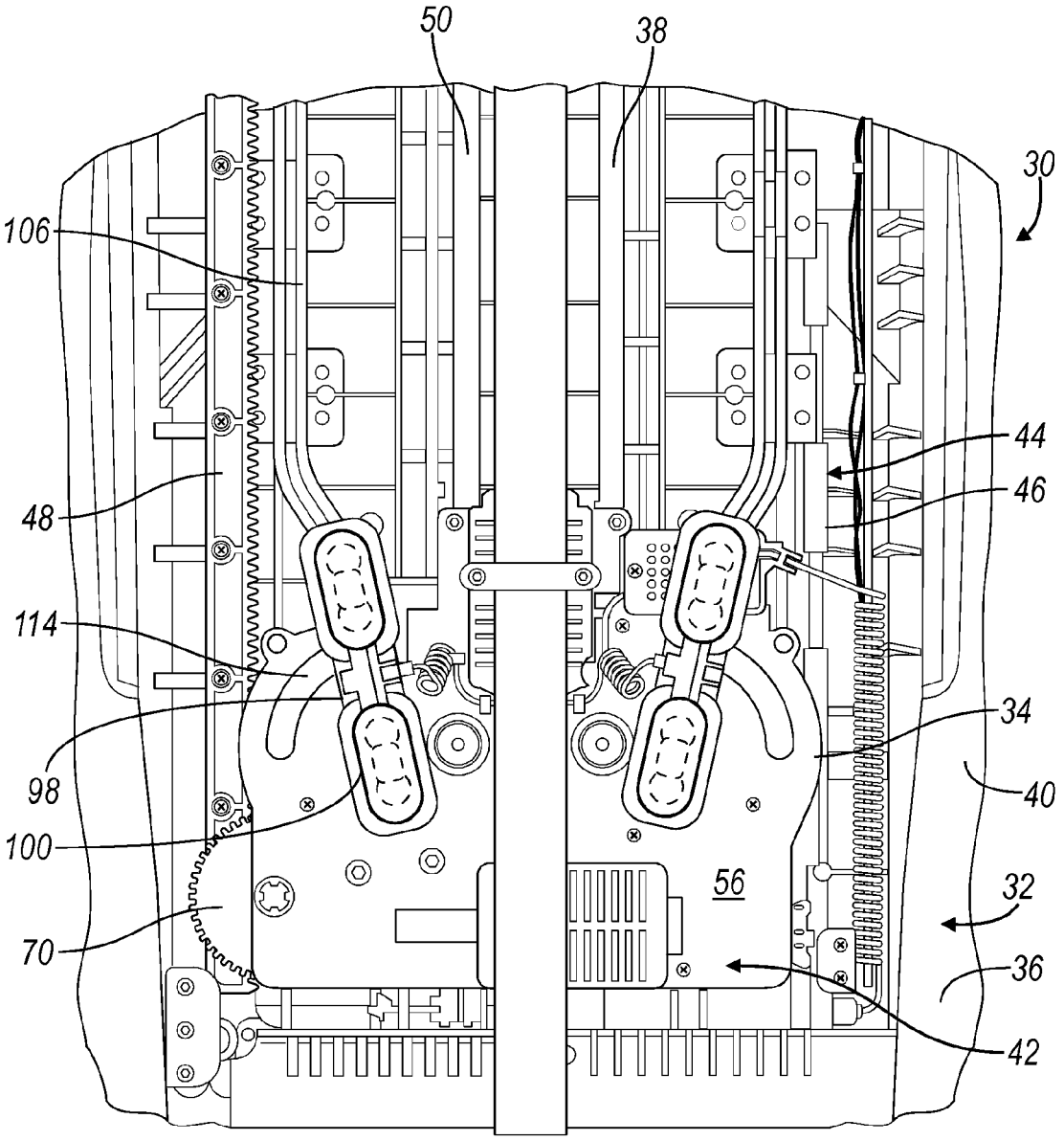
FIG. 4 is an enlarged elevation view of a massage assembly of the body massager of FIG. 3.
Figure 5:
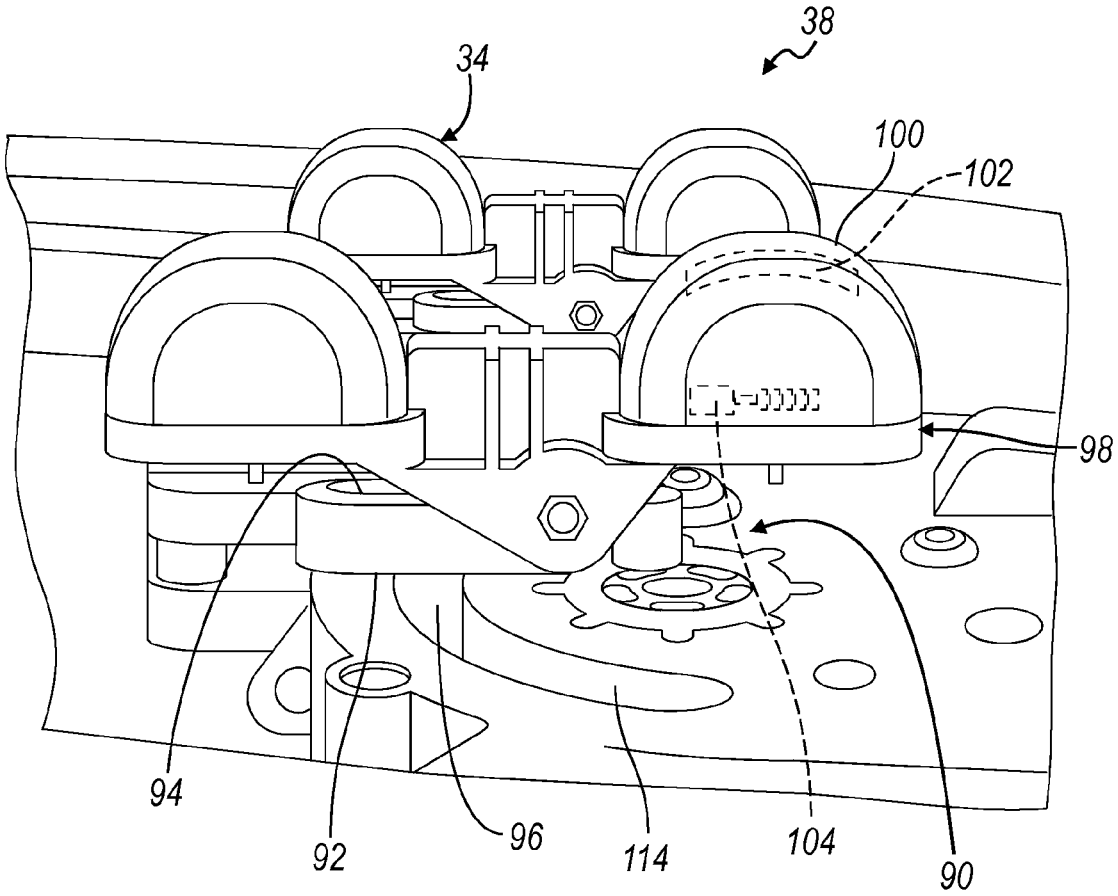
FIG. 5 is a side perspective view of the massage assembly of FIG. 4.
Figure 6:
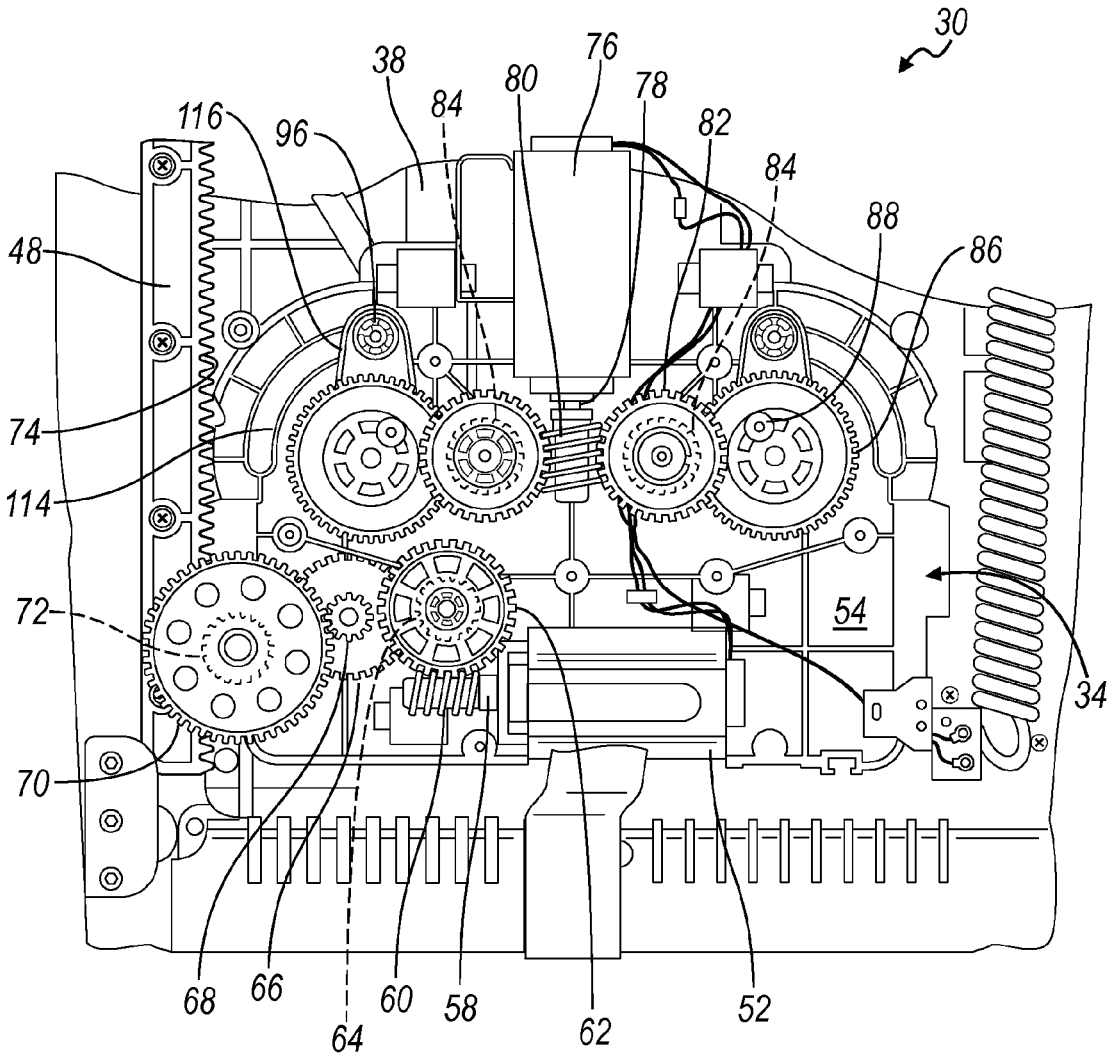
FIG. 6 is a front elevation view of the massage assembly of FIG. 4, illustrated partially disassembled.

Referring now to FIGS. 4-6, the massage assembly 34 is depicted with a transmission revealed in FIG. 6. The transmission includes a first motor 52, which is retained within a motor mount collectively provided by a substrate 54 (FIG. 6) and a cover plate 56 (FIGS. 4 and 5) of the carriage 42. Referring again to FIG. 6, the first motor 52 is operable to translate the carriage 42 along the guide 44 of the housing 38. The first motor 52 includes a motor output shaft 58 that drives a worm 60 that is mounted on the shaft 58. The worm 60 drives a worm gear 62 that is mounted for rotation to the carriage 42.

A first pinion gear 64 is mounted to the underside of the worm gear 62 and is driven by the worm gear 62. A first reduction gear 66 is mounted for rotation to the carriage 42 and is driven by the first pinion gear 64. The first reduction gear 66 includes a second pinion gear 68 mounted to a forward side that is driven with the first reduction gear 66. The second pinion gear 68 engages a second reduction gear 70 that is mounted for rotation to the carriage 42. A third pinion gear 72 is mounted to an underside of the second reduction gear 70. The third pinion gear 72 is engaged to a gear rack 74 formed along the retainer gib 48.

The worm 60, worm gear 62, first pinion gear 64, first reduction gear 66, second pinion gear 68, second reduction gear 70, third pinion gear 72, and gear rack 74 provide a transmission such that rotation from the motor output shaft 58 experiences multiple stages of reduction for reduced rotation of the third pinion gear 72 relative to the motor output shaft 58. Since the rack 74 is fixed relative to the guide 44, rotation of the third pinion gear 72 translates the carriage 42 along the guide 44. Of course, various transmission arrangements are contemplated within the scope of the invention.

The massage assembly 34 includes a second motor 76, which is mounted to the substrate 54 and the cover plate 56 of the carriage 42. The second motor 76 is operable to impart a rotary massage effect from the massage assembly 34. The second motor 76 includes a motor output shaft 78, which drives a worm 80 mounted on the shaft 78. The worm 80 drives a pair of worm gears 82 that are mounted for rotation of the carriage 42. The worm 80 drives the worm gears 82 in opposed rotational directions. Each worm gear 82 includes a pinion gear 84 mounted to the underside thereof. A pair of reduction gears 86 are each in engagement with one of the pinion gears 84 and driven by the pinion gears 84. An eccentric drive 88 is mounted on each reduction gear 86 with a pivotal connection that is offset from the rotational connection (or central axis) of the reduction gear 86 to the carriage 42.

Referring to FIG. 5, the eccentric drives 88 each extend through the cover plate 56 of the carriage 42 and operate for driving a slider crank mechanism 90. The slider crank mechanism 90 includes a link 92 that is pivotally connected to the eccentric drive 88. The link 92 also has a slot 94 that is mounted to a shaft 96 extending from the carriage. The slot 94 receives the shaft 96 for pivoting and sliding of the link 92 relative to the shaft 96. Thus, rotation of the eccentric drive 88 causes the link 92 to oscillate as it pivots about the eccentric drive 88 while also pivoting and sliding relative to the shaft 96.

A pair of lever arms 98 are each pivotally connected to one of the links 92. Each lever arm 98 includes a pair of massage nodes 100 mounted on opposed ends thereof for providing a rotary kneading massage effect as the links 92, and consequently the massage nodes 100, are oscillated relative to the carriage 42 while driven by the second motor 76. The pivotal connection of each lever arm 98 to the corresponding link 92 provides compliance of the angular orientation of the nodes 100 relative to the carriage 42 in order to maintain contact of the nodes 100 with a body part of the user as the nodes 100 translate along curved surfaces of the user.

The massage nodes 100 are each generally hemi-ellipsoidal and may include a heater 102 for heating the contact surface. Additionally, the massage nodes 100 may be generally translucent. A light source, such as a light emitting diode 104, may be provided beneath each massage node 100 for illuminating the massage nodes 100 and providing an illuminated effect for displaying a mode of operation and for illustrating a path of travel and/or massage. Alternatively, the LEDs 104 may be infrared LEDs 104 for providing a heated effect to the massage nodes 100.

Figure 7:
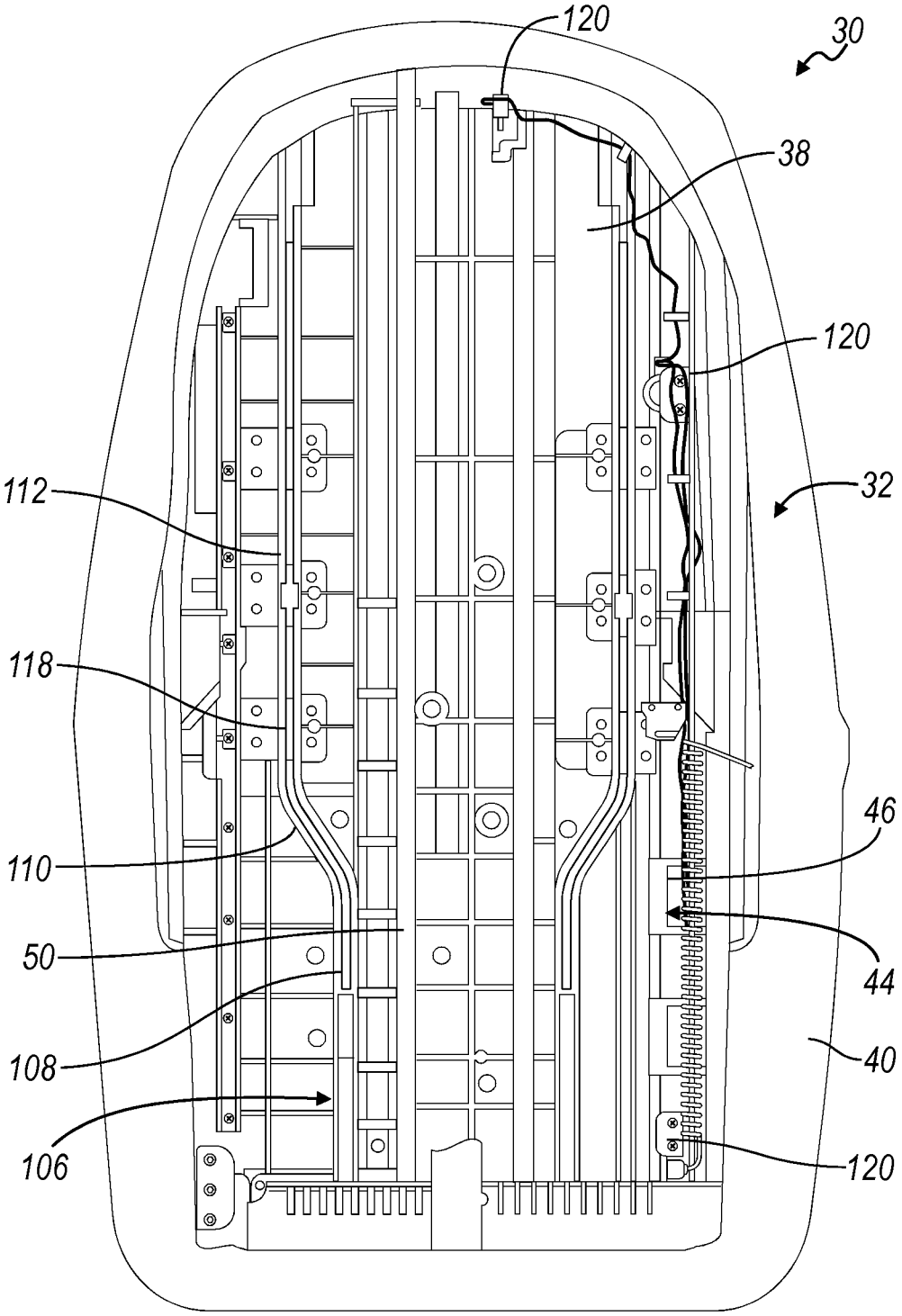
FIG. 7 is a front elevation view of the body massager of FIG. 3, illustrated with the massage assembly removed therefrom.

Referring now to FIG. 7, the housing 38 includes a pair of secondary guides 106. The secondary guides 106 each extend longitudinally along the housing 38; however, the secondary guides 106 also vary transversely. For example, in the depicted embodiment, the secondary guides 106 include lumbar regions 108 wherein the guides 106 are spaced narrowly and parallel. The guides 106 also include intermediate transition regions 110 that are each canted for extending the guides 106 laterally outboard. The guides 106 also include shoulder and upper back regions 112 that are generally parallel in the longitudinal direction and are spaced wider apart than the spacing at the lumbar regions 108.

The shafts 96 of the carriage 34 are received within the secondary guides 106 as illustrated in FIG. 6. The shafts 96 are also received within arcuate tracks 114 formed into the carriage 42. Thus, as the carriage 42 travels along the longitudinal guides 44, the shafts 96 are translated within the arcuate tracks 114 as determined by the secondary guides 106. In a lowermost position of the carriage 42, the lever arms 98 and the massage nodes 100 are oriented in a generally longitudinal orientation that is generally parallel with the first guides 44. As the carriage 42 travels upward, and the shafts 96 are translated into the transition regions 110, the lever arms 98 are each rotated so that the lever arms 98 are each oriented transversely for broadening the area of contact by the massage nodes 100 and the shoulder and upper back regions 112. Of course, various track configurations are contemplated within the spirit and scope of the invention. The secondary guides 106 are illustrated generally asymmetrical for an asymmetrical massage effect upon the body part of the user. Of course, various patterns and configurations such as symmetrical are contemplated under the invention.

The shafts 96 travel circumferentially in the arcuate tracks 114, which may be coaxial with the reduction gears 86. The shafts 96 may also be mounted to a support plate 116 that is pivotally connected to the carriage 42 coaxial with each reduction gear 86 for sharing a common axis. The support plates 116 may be utilized for maintaining the shafts 96 in an upright position, for minimizing binding, and for enhancing smoothness of transitions of the shaft 96 from the longitudinal regions 108, 112 to the transition regions 110.

Operation of the motors 52, 76 can be controlled by a remote control. Operation of the first motor 52 only results in a longitudinal kneading massage effect as the massage nodes 100 are slid along the back of the user. The nodes 100 converge narrowly in the lumbar region 108 and broaden out to a transverse alignment in the shoulder and upper back regions 112. Operation of the second motor 76 causes the massage nodes 100 to oscillate thereby providing a rotary kneading massage effect. Operation of both motors 52, 76 results in a rotary kneading massage effect that translates to the various regions with the width varying from the lumbar region 108 to the shoulder and upper back regions 112. The first motor 52 can be utilized for moving the carriage 42 to a targeted position for applying the rotary kneading massage effect at that specific position.

Referring again to FIG. 7, the housing 38 may include a series of cross supports 118 each mounted to an underside of the secondary guides 106 for providing additional support to the housing 38. Limit switches 120 may be utilized for detecting ranges of travel of the carriage 34 to the extends of the range for reversing the direction of the first motor 52, or may be provided incrementally for limiting to user selected ranges.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A massager comprising:

a housing having an external contact surface for receiving a portion of a body of a user;

a first guide mounted to the housing and oriented generally in a longitudinal direction of the housing;

a carriage oriented in the housing and cooperating with the first guide for limited longitudinal translation in the housing along the first guide;

a motor supported upon one of the carriage and the housing and operably connected to the other of the carriage and the housing for translating the carriage along the first guide;

a second guide mounted to the housing and oriented generally canted relative to the longitudinal direction of the housing; and at least one massage member pivotally connected to the carriage and pivotally connected to the second guide such that as the carriage is translated along the first guide, an angular orientation of the massage member is rotated relative to the carriage;

wherein the second guide comprises a first region generally parallel with the first guide for maintaining the angular orientation of the at least one massage member as the carriage travels along the first region, and a second region canted relative to the first guide for pivoting the at least one massage member as the carriage travels along the second guide.

2. The massager of claim 1 wherein the at least one massage member comprises a lever arm having a pair of massage nodes.

3. The massager of claim 2 further comprising at least one heater provided in at least one of the pair of massage nodes.

4. The massager of claim 2 further comprising at least one light source provided in at least one of the pair of massage nodes.

5. The massager of claim 2 further comprising a shaft extending from the carriage and received in the second guide for pivotally supporting the lever arm.

6. The massager of claim 5 further comprising an arcuate track formed in the carriage for receiving the shaft, such that as the shaft is translated laterally during travel along the second guide, the shaft translates circumferentially within the arcuate track, thereby rotating the lever arm relative to the carriage.

7. The massager of claim 5 further comprising an eccentric drive provided on the carriage, the eccentric drive being connected to the lever arm to oscillate the lever arm relative to the carriage.

8. The massager of claim 7 further comprising a second motor mounted to the carriage for driving the eccentric drive.

9. The massager of claim 5 further comprising a slider crank mechanism connected to the carriage and the shaft for supporting the lever arm and oscillating the lever arm relative to the carriage.

10. The massager of claim 9 wherein the lever arm is pivotally connected to the slider crank mechanism about an axis generally perpendicular to the shaft for permitting the lever arm and massage nodes to pivot in a fore and aft direction relative to the housing.

11. The massager of claim 1 wherein the second guide further comprises a third region spaced apart from the first region by the second region, the third region being generally parallel with the first guide for maintaining the angular orientation of the at least one massage member as the carriage travels along the third region.

12. The massager of claim 11 wherein the second guide further comprises a pair of second guides with asymmetrical second regions; and wherein the at least one massage member comprises a pair of massage members each pivotally connected with one of the second guides for asymmetrical rotation of the massage members relative to the carriage.

13. A massager comprising:

a housing having an external contact surface for receiving a portion of a body of a user;

a first guide mounted to the housing and oriented generally in a longitudinal direction of the housing;

a carriage oriented in the housing and cooperating with the first guide for limited longitudinal translation in the housing along the first guide;

a motor supported upon one of the carriage and the housing and operably connected to the other of the carriage and the housing for translating the carriage along the first guide;

a pair of asymmetrical second guides mounted to the housing, each second guide comprising a first region generally parallel with the first guide for maintaining the angular orientation of the at least one massage member as the carriage travels along the first region, a second region canted relative to the first guide for pivoting the at least one massage member as the carriage travels along the second guide, and a third region spaced apart from the first region by the second region, the third region being generally parallel with the first guide for maintaining the angular orientation of the at least one massage member as the carriage travels along the third region; and a pair of massage arms each having a pair of massage nodes, each massage arm being pivotally connected to the carriage and pivotally connected to one of the second guides such that as the carriage is translated along the second guides, an angular orientation of the pair of massage members is rotated asymmetrically relative to the carriage.

14. A massager comprising:

a housing having an external contact surface for receiving a portion of a body of a user;

a first guide mounted to the housing and oriented generally in a longitudinal direction of the housing;

a carriage oriented in the housing and cooperating with the first guide for limited longitudinal translation in the housing along the first guide;

a motor supported upon one of the carriage and the housing and operably connected to the other of the carriage and the housing for translating the carriage along the first guide;

a second guide mounted to the housing and oriented generally canted relative to the longitudinal direction of the housing;

at least one massage member pivotally connected to the carriage and pivotally connected to the second guide such that as the carriage is translated along the first guide, an angular orientation of the massage member is rotated relative to the carriage, the at least one massage member comprising a lever arm having a pair of massage nodes;

a shaft extending from the carriage and received in the second guide for pivotally supporting the lever arm; and a slider crank mechanism connected to the carriage and the shaft for supporting the lever arm and oscillating the lever arm relative to the carriage;

wherein the lever arm is pivotally connected to the slider crank mechanism about an axis generally perpendicular to the shaft for permitting the lever arm and massage nodes to pivot in a fore and aft direction relative to the housing.

* * * * *